US007483650B2

(12) United States Patent
Freudenberg et al.

(10) Patent No.: US 7,483,650 B2
(45) Date of Patent: Jan. 27, 2009

(54) METHOD AND DEVICE FOR DETECTION OF THE SPEED DIFFERENCE BETWEEN AN IMAGE CARRIER AND A CARRIER MATERIAL

(75) Inventors: Frank Freudenberg, Markt Schwaben (DE); Hans Winter, Munich (DE)

(73) Assignee: OCE Printing Systems GmbH, Poing (DE)

( * ) Notice: Subject to any disclaimer, the term of this patent is extended or adjusted under 35 U.S.C. 154(b) by 243 days.

(21) Appl. No.: 11/635,981

(22) Filed: Dec. 7, 2006

(65) Prior Publication Data

US 2007/0134022 A1 Jun. 14, 2007

(30) Foreign Application Priority Data

Dec. 9, 2005 (DE) ..... 10 2005 058 953

(51) Int. Cl.
*G03G 15/00* (2006.01)

(52) U.S. Cl. ..... 399/167; 399/301; 399/303

(58) Field of Classification Search ..... 399/130, 399/162, 165, 167, 301, 303; 347/116
See application file for complete search history.

(56) References Cited

U.S. PATENT DOCUMENTS

| | | | | |
|---|---|---|---|---|
| 5,927,196 | A | 7/1999 | Murray | |
| 6,068,172 | A | 5/2000 | Huber | |
| 6,246,856 | B1 | 6/2001 | Kopp et al. | |
| 6,336,024 | B1 * | 1/2002 | Kanaya et al. | 399/301 |
| 6,771,919 | B2 * | 8/2004 | Koide | 399/167 |
| 7,127,202 | B2 * | 10/2006 | Fujita et al. | 399/307 |
| 7,343,127 | B2 * | 3/2008 | Yamada et al. | 399/301 |
| 2005/0089350 | A1 | 4/2005 | Winter et al. | |

FOREIGN PATENT DOCUMENTS

| | | |
|---|---|---|
| DE | 297 20 235 | 3/1998 |
| DE | 198 28 388 | 11/2000 |
| DE | 103 38 497 | 3/2005 |
| DE | 103 38 496 | 4/2005 |

* cited by examiner

*Primary Examiner*—Hoan H Tran
(74) *Attorney, Agent, or Firm*—Schiff Hardin LLP

(57) ABSTRACT

In a method and a system for generation of print images on a carrier material, an actual speed difference is generated in a transfer printing region between an image carrier and the carrier material. A deviation of the actual speed difference from a desired speed difference is determined with aid of a measurement arrangement.

17 Claims, 3 Drawing Sheets

METHOD AND DEVICE FOR DETECTION OF THE SPEED DIFFERENCE BETWEEN AN IMAGE CARRIER AND A CARRIER MATERIAL

BACKGROUND

The preferred embodiment concerns a method in which a speed difference is generated in a transfer printing region between an image carrier and a carrier material. The preferred embodiment also concerns a device for implementation of the method.

High-capacity printing systems for printing of a paper web are known from the documents DE 103 38 496 B3 and DE 103 38 497 A1, in which toner images present on the transfer belt are transfer-printed onto the paper web at a transfer printing point. The drive speed of the transfer belt is preset somewhat greater than the transport speed of the paper web, whereby a speed difference is present between the paper web 12 and the transfer belt. The speed difference is advantageously in the range from 0.1% to 10%, in particular in the range from 0.5% to 3% given a printing speed from 0.9 to 2 m/sec.

A printing system for printing of an endless paper web is known from the document U.S. Pat. No. 6,068,172, which printing system has a device for length compensation of a paper web to be printed in order to generate a preset tensile stress of the paper web in a transfer printing region.

A method and a device for transport of a web-shaped recording medium are known from the document DE 198 28 388 C2, in which method and device a length compensation element is provided with which a sensor is functionally coupled in order to determine the speed difference between a transport device arranged before the length compensation element and a transport device arranged after the length compensation element.

From the document U.S. Pat. No. 6,246,856 B1 a high-capacity printer and high-capacity copier is known in which toner images are generated that are transferred onto a recording medium. A plurality of developer stations are arranged along a photoconductor belt for generation of multi-color toner images, via which developer stations the color separations of a multi-color toner image are generated. The generated toner images of the color separations are successively transferred onto a transfer belt, whereby the individual color separations are thereby printed atop one another in registration. The color separations are thereby collected on the transfer belt. In a feed module what is known as a loop snag is provided via which the tensile stress of the carrier material to be printed is kept relatively constant.

A correct speed difference between the transfer belts serving as image carriers or the transfer belt serving as an image carrier and the carrier material to be printed is a decisive variable for the quality of the transfer printing of toner images onto the carrier material. If the speed difference is too great or too small, disruptions in the print image (for example what are known as wipes) arise or, for example, folds are formed in the carrier material to be printed. The carrier material can flutter in the region before the transfer printing point due to such folds, whereby the transfer printing conditions in the transfer printing region vary continuously. The actual speed difference does not remain constant due to various tolerances of arrangements for direction and propulsion of the carrier material as well as for direction and propulsion of the image carrier as well as variations of the direction and of the propulsion of the image carrier and of the carrier material during the print operation. The speed difference cannot be set or maintained exactly both over a longer image generation process and due to aging and/or wear of components of a printer or copier.

SUMMARY

It is an object to specify a method and an arrangement for generation of print images on a carrier material, in which method and arrangement the print images are transfer-printed from an image carrier onto a carrier material to be printed in a simple manner and in high quality.

In a method and a system for generation of print images on a carrier material, an actual speed difference is generated in a transfer printing region between an image carrier and the carrier material. A deviation of the actual speed difference from a desired speed difference is determined with aid of a measurement arrangement.

DESCRIPTION OF THE PREFERRED EMBODIMENTS

Figure 1:
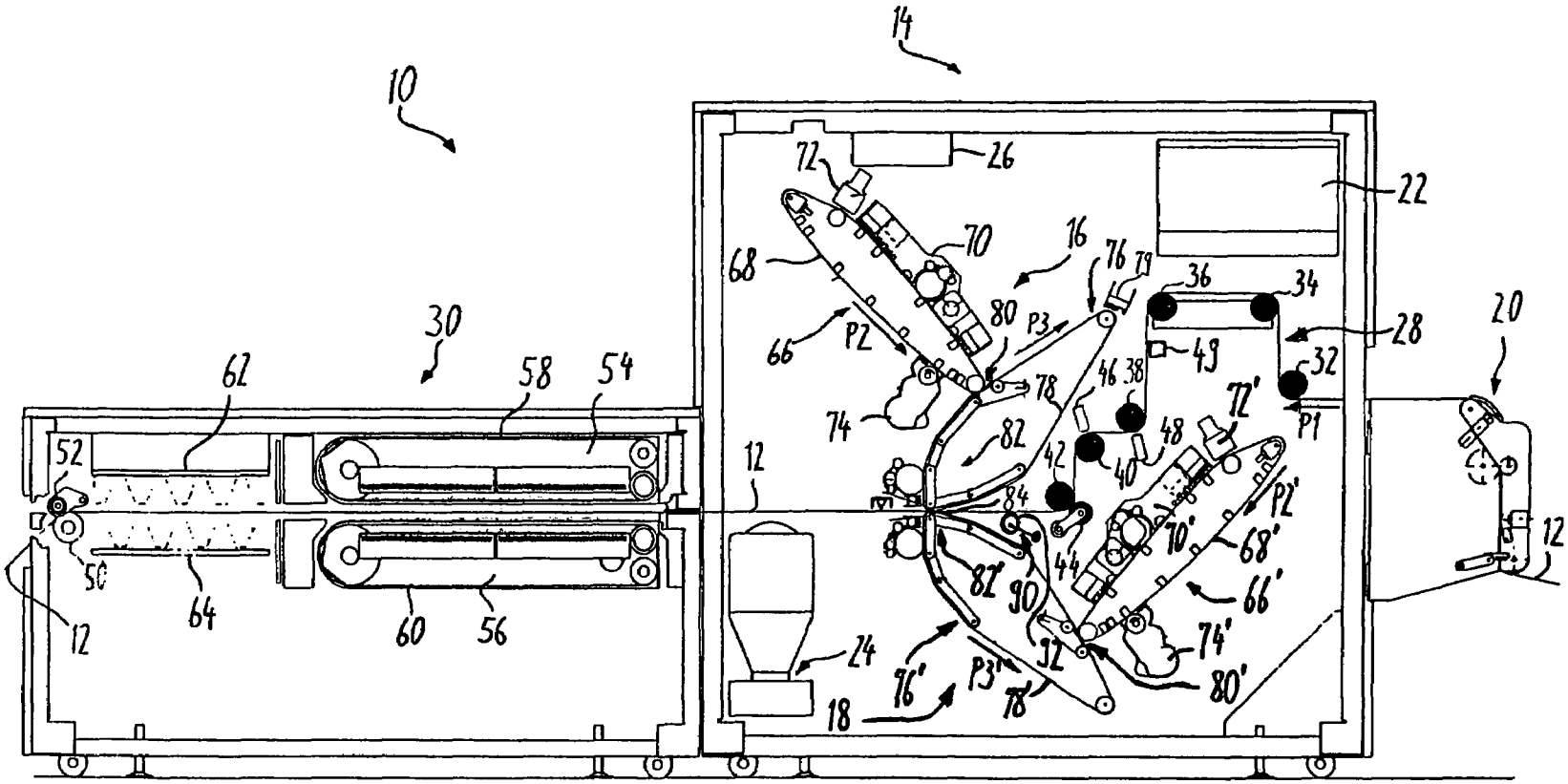
FIG. 1 shows the schematic design of a high-capacity printing system with two printing groups.

For the purposes of promoting an understanding of the principles of the invention, reference will now be made to preferred embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In a method and system for generation of print images on a carrier material, an actual speed difference is generated between an image carrier and the carrier material in a transfer printing region. A deviation of the actual speed difference from a desired speed difference is determined.

Via the method and the device of the preferred embodiment it is achieved that, via the determination of the deviation of the actual speed difference from a present speed difference, suitable measures can be taken in order (with the aid of suitable measures via the knowledge of the deviation) to set to a value that at least lies in a preset range in which a qualitatively high-grade transfer printing on the carrier material is possible. The speed difference can thereby be set exactly and kept constant even given variations of the direction and propulsion systems during the print operation as well as variations due to the aging or wear of elements of a printer or copier system.

The paper tension is advantageously detected as a measure for the actual speed difference and the actual speed difference is thereby regulated to a defined preset value. The paper tension can be detected in a simple manner with the aid of known measurement devices.

An electrophotographic high-capacity printing system 10 for printing of an endless paper web 12 with a printing speed in the range from 0.9 m/s to 2 m/s is shown in FIG. 1. A printing module 14 comprises a first image generation and transfer printing unit 16 for printing of the front side of the paper web 12 as well as a second image generation and transfer printing unit 18 for printing of the back side of the paper web 12. The image generation and transfer printing units 16, 18 are designated in the following as printing units 16, 18. The printing unit 16 is essentially structurally identical to the printing unit 18. Coinciding components of the first printing unit 16 and of the second printing unit 18 are therefore identified with the same reference characters, whereby the reference character for identification of the components of the second printing unit 18 are additionally provided with an apostrophe. Differences between the first printing unit 16 and the second printing unit 18 are explained in further detail below.

The printing module 14 furthermore comprises a paper feed 20, a control unit 22, a toner reservoir and preparation system 24, an image data processing unit 26 as well as a paper web propulsion and direction system 28.

The paper web 12 is transported through the printing system 10 in the direction of the arrow P1 with the aid of the paper web propulsion and direction system 28, whereby the paper web 12 is supplied to a fixing station 30 in the printing module 14 after the printing, in which fixing station 30 the toner images generated on the paper web 12 by the printing module are fixed. The paper web direction and monitoring system 28 comprises deflection rollers 32 through 40 as well as a roller pair with a drive roller 42 and a contact pressure roller 44 situated opposite the drive roller 42. Two marker sensors 46, 48 are also provided that monitor the entrance of synchronization markers applied on the paper web. Furthermore, a margin hole sensor 49 is provided that determines the entrance or the position of the margin holes contained in the paper web 12, whereby the margin holes and/or synchronization markers are brought into a desired position and/or held in this desired position with the aid of a regulation via corresponding activation of the drive motor of the paper web 12.

The first printing unit 16 and the second printing unit 18 are arranged on opposite sides of the paper web 12. With the aid of the drive roller 42 the paper web 12 can be transported in the arrow direction of the arrow P1 and in the opposite direction, whereby in the following the transport of the paper web 12 in the arrow direction of the arrow P1 is designated with "forward movement" and the transport of the paper web 12 in the direction opposite the arrow P1 is designated with "backward movement". The functions of the printing module 14 and of the fixing station 30 are described in detail in the documents WO 00/34831 and DE 198 27 210 C1, whose content is herewith incorporated by reference into the present specification.

The first printing unit 16 comprises a first belt drive 66 with a photoconductor belt 68 (for example an organic photoconductor belt) that is typically also designated as an OPC belt. The photoconductor belt 68 is driven in the arrow direction of the arrow P2 with the aid of the belt drive 66. With the aid of a cleaning and charging unit 70 the photoconductor belt 68 is discharged, toner residues are removed from the photoconductor belt 68 and the photoconductor belt 68 is charged to a predetermined uniform potential. With the aid of a character generator 72 that is executed as an LED character generator, regions of the surface of the photoconductor belt 68 that are charged to the same potential are (dependent on the employed electrophotographic principle) partially (i.e. per image point) discharged to a lower potential or charged to a higher potential corresponding to the signals supplied to the character generator 72 by the image processing unit 26, whereby a charge image is generated on the surface of the photoconductor belt 68. The charge image located on the surface of the photoconductor belt 68 is a latent print image. With the aid of a developer unit 74 the charge image on the surface of the photoconductor belt 68 is developed (i.e. inked with toner) into a toner image.

The first printing unit 16 furthermore comprises a second belt drive 76 with a transfer belt 78 that is driven in the direction of the arrow P3. The photoconductor belt 68 contacts the transfer belt 78 at a first transfer printing point 80 (meaning that the surface of the photoconductor belt 68 touches the surface of the photoconductor belt 78), whereby a toner image located on the photoconductor belt 68 is transferred to the surface of the transfer belt 78.

With the aid of a roller pivoting device 82 whose rollers are connected with one another via levers, the transfer belt 78 is directed onto the paper web 12 (i.e. pivoted onto the paper web 12) and directed away from this (i.e. pivoted away from the paper web 12) at a second. transfer printing point 84, whereby the transfer belts 78, 78' are pivoted onto the paper web 12 in FIG. 1. The transfer belts 78, 78' of the printing unit 16 and of the printing unit 18 are essentially simultaneously pivoted onto the paper web 12, whereby a contact pressure is generated between two opposite rollers or roller pairs of the belt drives 76, 76' of the transfer belts 78, 78'. In the pivoted-towards state the transfer belt 78 contacts the surface of the paper web 12 on its front side and the transfer belt 78' on its back side, whereby the toner images located on the transfer belts 78, 78' are transferred from the transfer belts 78, 78' onto the front side as well as onto the back side of the paper web 12. The pivoting of a transfer belt 78, 78' towards and the pivoting of the transfer belt 78, 78' away. from the paper web 12 is described in detail in the document WO 00/54266; the content of which is herewith incorporated by reference into the present specification.

In contrast to the second printing unit 18, a reloading unit 86 for reloading of the toner image located on the transfer belt 78 is arranged at the belt drive 76 of the first printing unit 16. The toner image on the transfer belt 78 is reloaded with the aid of a reloading unit 79 that is embodied as a corotron arrangement. The toner particles of the toner images of the front side and back side have different charges due to the reloading of the toner image on the transfer belt 78, such that the transfer of the toner images onto the paper web 12 at the transfer printing point 84 is enabled by the attraction forces between the oppositely-charged toner particles through the paper web 12. The toner images are thereby transfer-printed from the transfer belts 78, 78' onto the paper web 12 at the second transfer printing point 84.

The paper web 12 with the toner images is subsequently supplied to the fixing station 30. The fixing station 30 comprises a first fixing unit 54 and a second fixing unit 56 that are arranged on the opposite sides of the paper web 12, whereby the first fixing unit 54 fixes the toner images on the front side of the paper web 12 and the second fixing unit 56 fixes the toner images on the back side of the paper web; the toner images are thereby permanently bonded with the paper web 12. The fixing units 54, 56 are executed as radiation fixing units, whereby the fixing units 54, 56 respectively comprise an occlusion unit 58, 60 that masks the radiation of the fixing units 54, 56 during operating states in which no fixing of the toner images on the paper web 12 should occur. Viewed in the transport direction of the paper web 12, cooling elements 62, 64 that cool the paper web 12 before the exit from the fixing station 30 are provided after the fixing units 54, 56 in order to prevent a damage to the paper web 12, in particular as a consequence of too little paper moisture. A further drive roller 50 with opposing contact pressure roller 52 is provided in the fixing station 30 for paper extraction.

The drive speed of the transfer belts 78, 78' contacting the paper web 12 is set somewhat higher than the transport speed of the paper web 12, such that a speed difference between the paper web 12 and the transfer belts 78, 78' is preset. The speed difference is advantageously in the range from 0.1% to 10% (advantageously 0.5% to 3%) when the transfer belts 78, 78' are pivoted onto the paper web 12 and contact this. The speed difference serves to hold the relatively elastic paper web 12 under tension at the transfer printing point 84 and therewith to avoid paper travel problems such as paper fluttering. If the transfer belt 78 is pivoted onto the paper web 12 as described, a tensile force of the transfer belt 78 acts on the paper web 12 in its transport direction P1 as a consequence of the higher speed.

In a region before the transfer printing point 84 in the transport direction P1 of the paper web 12, a measurement arrangement 90 is arranged between the roller pair 42, 44 and the transfer printing point 84, which measurement arrangement 90 comprises a roller 92 that is pressed from below against the paper web 12. The measurement arrangement 90 is designed such that the roller 92 is pressed with a relatively constant force against the underside (back side) of the paper web 12 and the deflection of the roller 92 is detected. The deflection of the roller 92 is dependent on the deflection of the paper web 12 that is effected by the force exerted on the paper web 12 by the roller 92. Depending on the tensile stress of the paper web 12 in the region between the roller pair 42, 44 and the transfer printing point 84, the paper web 12 is deflected only slightly by the force introduced by the roller 92 given a relatively large tensile stress and relatively significantly given a relatively slight tensile stress. The force exerted on the paper web 12 by the measurement arrangement 90 via the roller 92 acts essentially orthogonal to the plane in which the paper web 12 is conveyed in the region between the rollers 42, 44 and the transfer printing region 84. The tensile stress of the paper web 12 in the region between the roller pair 42, 44 and the transfer printing point 84 significantly depends on the speed difference between the transfer belts 78, 78' and the paper web 12 in the transfer printing region 84. Due to the deflection of the paper web 12 as a result of the force exerted on the paper web 12 by the measurement arrangement 90, the tension of the paper web 12 can thus be detected as a measure for the speed difference between the transfer belts 78, 78' and the paper web 12.

Alternatively, the paper web 12 can be deflected by a preset amount with the aid of the measurement device 90, Whereby a different force is required for deflection dependent on the tensile stress of the paper web 12 in the region of the measurement arrangement 90. The force required by the measurement arrangement 90 for deflection of the paper web 12 is detected with the aid of the measurement arrangement 90, whereby the required force serves as a measure for the tension of the paper web and thus for the speed difference between the transfer belts 78, 78' and the paper web 12.

Figure 2:
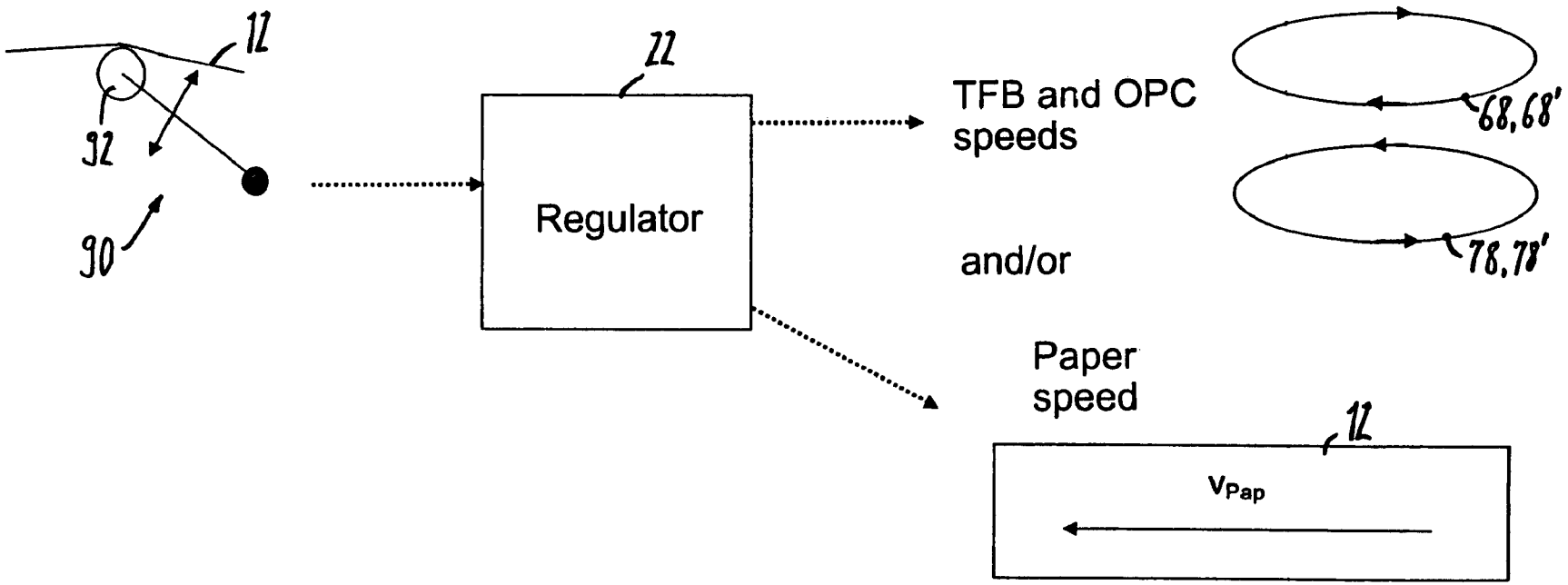
FIG. 2 is a block diagram for adjustment of the speed difference between a transfer belt and a paper web in a high-capacity printing system according to FIG. 1 according to a further embodiment of the invention.

A block diagram for adjustment of the speed difference between the transfer belts 78, 78' and the paper web 12 according to a first embodiment of the invention is shown in FIG. 2. The same elements are provided with the same reference characters. The value (detected with the aid of the measurement arrangement 90) of the tensile stress of the paper web 12 is supplied to the control unit 22, which comprises a regulator module for regulation of the difference speed between the transfer belts 78, 78' and the paper web 12.

The control unit 22 compares the value (determined for the first time with the aid of the measurement arrangement 90) for the speed difference between the transfer belts 78, 78' and the paper web 12 with a predetermined desired value and determines the control deviation between the determined real value and the predetermined desired value. The control unit controls the drive speeds of the photoconductor belts 68, 68' as well as of the transfer belts 78, 78' and/or the drive speed of the paper web 12 dependent on this deviation. The drive speeds of the respective transfer belt 78, 78' and of the photoconductor belt 68, 68' associated with the same printing unit 14, 16 are respectively altered identically, advantageously by the same amount. The drive speeds of the transfer belts 78, 78' and of the photoconductor belts 68, 68' of the upper first printing unit 16 and of the lower second printing unit 18 are also varied in the same manner, such that the association and positioning of the print images on the front side of the paper web 12 and the back side of the paper web 12 are further retained and the print images on the front side and the back side are arranged in register relative to one another. It is in particular to be observed that, in the high-capacity printing system according to FIG. 1, the path which the toner image travels on the transfer belt 78 of the upper first printing group is longer than the transport path of a toner image on the transfer belt 78' of the second, lower printing unit.

Via the alternative or additional modification of the drive speed of the paper web 12 the form length that specifies the length of the print image of a print side is changed slightly since then the drive speed of the paper web 12 no longer coincides with the writing speeds of the character generators 72, 72'. The speed changes to be expected for regulation of the speed difference between the transfer belts 78, 78' and the paper web 12 occur only by some thousandths or sub-thousandths, whereby the form length likewise changes only in this range and thereby lies within the required precision.

In addition to or as an alternative to the change of the drive speed of the paper web 12, the change of the drive speed of the transfer belts 78, 78' as well as of the photoconductor belts 68, 68' can in particular occur when the print images on the paper web 12 are regulated in an unregulated print operation without a regulation of the position of the print image to margin holes provided on the edge of the paper web 12 or position markers printed on the paper web.

Figure 3:
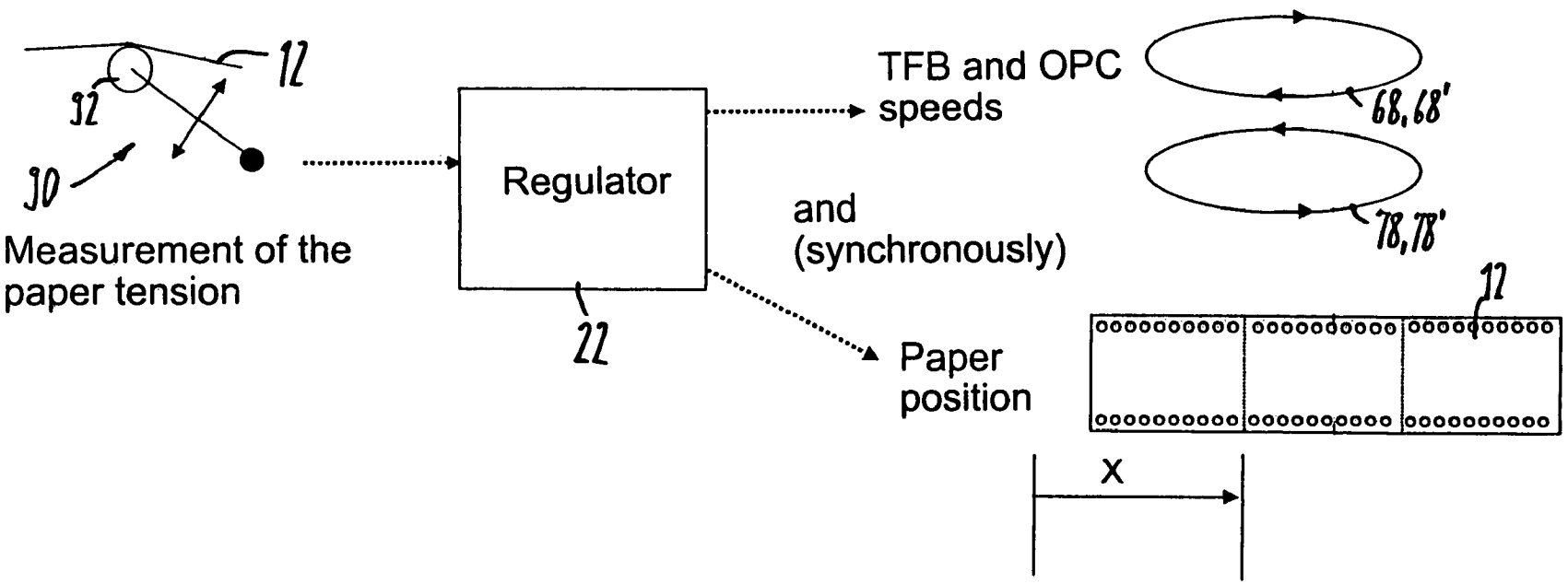
FIG. 3 is a block diagram for adjustment of the speed difference between the transfer belt and the carrier material in a high-capacity printing system according to FIG. 1 according to a second embodiment of the invention.

A block diagram for adjustment of the speed difference between the transfer belts 78, 78' and the paper web 12 is shown in regulated print operation in FIG. 3 according to a second embodiment of the invention. In the regulated print operation the positions of the print images printed on the paper web 12 are controlled or regulated with the aid of margin holes provided in the lateral margin regions of the paper web 12 and/or with the aid of position markers printed on the paper web 12. In this embodiment the drive speed of the paper web 12 cannot be varied to adjust or regulate the speed difference between the transfer belts 78, 78' and the paper web 12 since the drive speed of the paper web 12 is predetermined by the marker or hole regulation for positioning of the print images. Thus only the drive speed of the transfer belts 78, 78' as well as, in the same manner, the drive speeds of the photoconductor belts 68, 68' can be varied to adjust the predetermined speed difference.

In the regulated print operation the initial position of the print images to be generated is additionally changed in synchronization with the change of the drive speed of the transfer belts 78, 78', and thus the desired value for marker or hole regulation is in particular adapted to the changed drive speeds of the transfer belts 78, 78'. This adaptation of the initial position of the print images is required since the time for transport of the print image from the character generators 72, 72' up to the transfer printing of the print images from the transfer belts 78, 78' onto the paper web 12 in the transfer printing region 84 are changed via the modification of the drive speeds of the photoconductor belts 68, 68' and of the transfer belts 78, 78'. The print image thus reaches the transfer printing region 84 at a different point in time, i.e. too early or too late after adaptation of the drive speeds, and without a compensation of the initial position of the print images would thereby be incorrectly positioned.

In the described embodiment of the invention the respective belts 68, 68', 78, 78' and/or the paper web 12 can be stopped and the speed specifications can be adapted to change the drive speeds of the photoconductor belts 68, 68' or of the transfer belts 78, 78' as well as additionally or alternatively to change the drive speed of the paper web 12. The high-capacity printing system 10 is subsequently restarted again to continue a begun printing process or to begin a further printing process. Alternatively or additionally, the drive speeds of the transfer belts 78, 78' of the photoconductor belts 68, 68' and/or of the paper web 12 can also be altered during the printing operation of the high-capacity printing system 10, in particular between two print images to be generated in succession.

The measurement of the paper tension of the paper web 12 between the propulsion of the paper web 12 with the aid of the rollers 42, 44 and the transfer printing point 84 occurs with the aid of the roller 9 of the measurement arrangement 90, which roller 92 is abutting on the underside of the paper web 12. Alternatively, the roller 92 can be arranged above the paper web 12 and press on the paper web 12 from above. Instead of a roller 92 that essentially extends over the entire width of the paper web 12, only one roller can also be provided that presses on the paper web 12 in a relatively narrow region. The paper tension is determined with the aid of the measurement device 90, either in that the force that the paper web 12 exerts on the roller 92 or with which the roller 92 must be pressed against the paper web 12 in order to deflect the paper web 12 is measured or in that the deflection of the roller 92 that is pressed against the paper web 12 with an essentially constant force is alternatively measured. The deflection can also be determined when the roller 92 is pressed against the paper web 12 with a force dependent on the deflection.

The speed difference between the transfer belts 78, 78' and the paper web 12 can be detected and regulated continuously in the described exemplary embodiments. Changes in the speed difference occurring in the operation of the high-capacity printing system, which changes can in particular occur due to a marker regulation or a hole regulation in a regulated print operation, are detected and corrected with the aid of the regulation or are limited to an allowable deviation. The speed difference can thereby be set to a relatively small desired value since, via the continuous detection of a deviation of the speed difference from this preset value, an immediate correction of the deviation is possible and the speed difference thereby does not have to be set unnecessarily high in order to be able to ensure the presence of a higher speed of the transfer belts 78, 78' relative to the drive speed of the paper web 12 even given disadvantageous conditions.

In a high-capacity printing system according to FIG. 1, the speed difference had to be set to a value of approximately 1% of the drive speed of the paper web 12 or of the transfer belts 78, 78' without the detection of the deviation of the actual speed difference from a desired speed difference. Problems in the print image positioning and the print quality result due to such a relatively high speed difference. These problems can be significantly reduced or entirely corrected via a smaller speed difference. The speed difference can in particular be set to a value in the range from 0.1% to 0.95% of the drive speed of the transfer belts 78, 78' or of the drive speed of the paper web 12 and thereby be regulated to this value.

The detection of the speed difference can also occur in printers or copiers that comprise only one printing unit 16, 18 for generation of a print image on the paper web 12. Other carrier materials (both web-shaped carrier materials and sheet-shaped carrier materials, in particular sheet-shaped paper) can also be printed both with the printing system 10 shown in FIG. 1 and with alternative printer or copier systems. Given printing of individual sheets, the leading and/or trailing edge of a single sheet can be detected for print image positioning on the individual sheet.

In the explained exemplary embodiments transfer belts 78, 78' are provided as image carriers between which and the paper web 12 to be printed wherein the speed difference between the image carriers and the paper web 12 to be printed is generated and detected. As an alternative to the transfer belts 78, 78', other image carriers (such as, for example, transfer drums, photoconductor drums or photoconductor belts) can also be provided between whose surface (on which a toner image is arranged) and the side of the paper web 12 (or an alternative carrier material) to be printed a speed difference is generated.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A method for generation of print images on a carrier material, comprising the steps of:

generating an actual speed difference between an image carrier and the carrier material in a transfer printing region; and determining a deviation of the actual speed difference from a desired speed difference.

2. A method according to claim 1 wherein a tension of the carrier material is determined as a measure for the actual speed difference between the image carrier and the carrier material.

3. A method according to claim 1 wherein a web-shaped carrier material is used as the carrier material.

4. A method according to claim 1 wherein a substantially constant force is exerted on the carrier material with aid of a cylinder or roller of a measurement device, said force acting substantially perpendicular to a plane in which the carrier material is directed, a deflection of the cylinder or roller being detected as a measure for the actual speed difference between the image carrier and the carrier material.

5. A method according to claim 1 wherein a force is exerted on the carrier material with aid of a cylinder or roller, said force acting substantially perpendicular to the plane in which the carrier material is directed, the force required for deflection of the cylinder or roller being determined as a measure for the speed difference between the image carrier and the carrier material.

6. A method according to claim 1 wherein a drive speed of the image carrier is altered dependent on a deviation of the actual speed difference from the desired speed difference.

7. A method according to claim 1 wherein a tension of the carrier material and/or the speed difference of the carrier material is regulated with aid of the determined deviation.

8. A method according to claim 1 wherein the image carrier comprises a photoconductor drum, a photoconductor belt, or a transfer belt.

9. A method according to claim 1 wherein a toner image to be transfer-printed onto the carrier material is generated on a photoconductor and transferred onto a transfer image carrier, said toner image being transfer-printed from the transfer image carrier onto the carrier material in the transfer printing region, and drive speeds of the photoconductor and of the transfer image carrier are altered dependent on the determined deviation.

10. A method according to claim 1 wherein a drive speed of the carrier material is altered dependent on the determined deviation in addition to or as an alternative to a change of a drive speed of an image carrier.

11. A method according to claim 1 wherein a change of drive speeds of the image carrier and/or of the carrier material is implemented after a halt of the image carrier or of the carrier material, or a change of the speed of the image carrier and/or of the carrier material is implemented during a propulsion of the image carrier or of the carrier material.

12. A method according to claim 1 wherein the actual speed difference is regulated to a value in a range from 0.1% to 0.95%.

13. A method according to claim 1 wherein the deviation is determined with aid of the measurement device in a region before the transfer printing region.

14. A method according to claim 1 wherein a circumferential velocity of the image carrier is greater than a transport speed of the carrier material.

15. A system for generation of print images on a carrier material, comprising:

an image carrier on Whose surface a toner image is present;

a transfer printing region in which a region of a generated surface of the image carrier contacts a surface of the carrier material for transfer printing of the toner image present on the image carrier onto the carrier material;

at least one drive unit that propels the image carrier with a first circumferential speed and propels the carrier material with a second speed differing from the circumferential speed of the image carrier; and a measurement device that determines a deviation of an actual speed difference between the image carrier and the carrier material from a desired speed difference.

16. A method for generation of print images on a carrier material, comprising the steps of:

generating an actual speed difference between an image carrier and the carrier material in a transfer printing region;

providing a deflectable body in contact with the carrier material and determining an amount of deflection of said body as a measure of said actual speed difference; and determining a deviation of the actual speed difference from a desired speed difference.

17. A system for generation of print images on a carrier material, comprising:

an image carrier on whose surface a toner image is present;

a transfer printing region in which a region of a generated surface of the image carrier contacts a surface of the carrier material for transfer printing of the toner image present on the image carrier onto the carrier material;

the image carrier being propelled with a first speed and the carrier material being propelled with a second speed differing from the speed of the image carrier; and a measurement system including a deflectable body in contact with the carrier material that determines a deviation of an actual speed difference between the image carrier and the carrier material from a desired speed difference.

* * * * *